US007011386B2

(12) United States Patent
Iwasaki et al.

(10) Patent No.: US 7,011,386 B2
(45) Date of Patent: Mar. 14, 2006

(54) PRINTING APPARATUS AND PRELIMINARY DISCHARGE CONTROL METHOD

(75) Inventors: Osamu Iwasaki, Tokyo (JP); Naoji Otsuka, Kanagawa (JP); Kiichiro Takahashi, Kanagawa (JP); Minoru Teshigawara, Kanagawa (JP); Yoshinori Nakagawa, Kanagawa (JP); Satoshi Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 10/636,687

(22) Filed: Aug. 8, 2003

(65) Prior Publication Data

US 2004/0041873 A1 Mar. 4, 2004

(30) Foreign Application Priority Data

Aug. 28, 2002 (JP) ..... 2002-249480

(51) Int. Cl.
*B14J 2/165* (2006.01)

(52) U.S. Cl. ..... 347/23; 347/29; 347/30; 347/35; 347/14

(58) Field of Classification Search ..... 347/23, 347/29, 30, 35, 14
See application file for complete search history.

(56) References Cited

U.S. PATENT DOCUMENTS

| | | | | |
|---|---|---|---|---|
| 3,925,789 | A * | 12/1975 | Kashio | 347/23 |
| 4,313,124 | A | 1/1982 | Hara | 346/140 |
| 4,345,262 | A | 8/1982 | Shirato et al. | 346/140 |
| 4,463,359 | A | 7/1984 | Ayata et al. | 346/1.1 |
| 4,723,129 | A | 2/1988 | Endo et al. | 346/1.1 |
| 4,740,796 | A | 4/1988 | Endo et al. | 346/1.1 |
| 4,977,459 | A * | 12/1990 | Ebinuma et al. | 358/296 |
| 5,617,122 | A | 4/1997 | Numata et al. | 347/14 |
| 6,109,724 | A * | 8/2000 | Takahashi et al. | 347/23 |
| 6,227,646 | B1 | 5/2001 | Yano et al. | 347/23 |
| 2001/0003457 | A1 | 6/2001 | Dol | 347/5 |
| 2002/0018092 | A1 | 2/2002 | Inui et al. | 347/23 |
| 2002/0196300 | A1 | 12/2002 | Takahashi et al. | 347/14 |

FOREIGN PATENT DOCUMENTS

| | | |
|---|---|---|
| EP | 0 962 321 | 12/1999 |
| JP | 63-252748 | 10/1988 |

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

A printing apparatus and a preliminary discharge control method are capable of efficient preliminary discharge control even in a case where a time interval to assure normal printing is equal or nearly equal to the period of one print scanning of an inkjet printhead. In the method, in an inkjet printhead which performs printing by discharging ink from plural print elements while being reciprocate-scanned by a carriage, the number of ink dischargings from each of the plural print elements is counted during print scanning by reciprocate scanning. It is determined whether or not the counted number of ink dischargings from each of the plural print elements is equal to or greater than a predetermined number at predetermined intervals. In accordance with the result of determination, a printable period is updated, and the updated printable period is compared with time necessary for the next print scanning upon completion of one print scanning by reciprocate scanning. Then, in accordance with the result of comparison, preliminary discharge is performed from the inkjet printhead.

13 Claims, 5 Drawing Sheets

PRINTING APPARATUS AND PRELIMINARY DISCHARGE CONTROL METHOD

CLAIM OF PRIORITY

This application claims priority under 35 U.S.C. § 119 from Japanese Patent Application No. 2002-249480, entitled "Printing Apparatus and Preliminary Discharge Control Method", and filed on Aug. 28, 2002, the entire contents of which are incorporated herein by reference.

FIELD OF THE INVENTION

The present invention relates to a printing apparatus and a preliminary discharge control method, and more particularly, to a printing apparatus which performs printing using an inkjet printhead and a preliminary discharge control method.

BACKGROUND OF THE INVENTION

In recent years, in accordance the with wide use of personal computers, word processors and facsimile machines in offices and homes, printers based on various printing methods have been developed as information output devices for the above devices. Among these printers, an inkjet printer, capable of color printing, having advantages of low operation noise, high-quality printing on various types of printing media, and further, its small size, is optimal for personal use in offices and homes. Above all, a serial-scan type inkjet printing apparatus (hereinbelow, simply referred to as a "printing apparatus"), in which a printhead performs printing while it is reciprocate-scanned across a print medium, is widespread in the market since it can print a high-quality image at a low cost.

The inkjet printhead (hereinbelow, simply referred to as a "printhead") performs printing by discharging ink droplets toward a print medium from fine holes (hereinbelow, referred to as "discharge orifices") of nozzles. At this time, in the printhead, the ink in each nozzle is reduced by discharge, and ink from an ink chamber is newly supplied by capillarity.

However, in a case where ink discharge is not performed for a long time, in the discharge orifice, water and solvent are evaporated and coloring material is deposited, and the deposited coloring material forms a film over the discharge orifice, which disturbs normal ink discharge. Since kinetic energy, generated for ink droplet discharge by the printing operation of the printhead, is consumed in breaking the film, a sufficient ink-droplet discharge speed cannot be obtained, thus an ink droplet cannot be applied to a desired position on the print medium.

In the printing apparatus, to prevent poor printing due to evaporation of water and solvent in the ink, the printhead is moved to the outside of the printing medium within a period where a film is not sufficiently formed over the discharge orifice, and ink discharge is made there (hereinafter, this discharge is referred to as "preliminary discharge"), thus the discharge orifice is maintained in a normal ink discharge status upon printing.

Generally, in a serial-scan type printing apparatus, upon returning movement of the carriage holding the printhead, it is determined whether or not a predetermined or longer period has elapsed from previous preliminary discharge, and if it is determined that a predetermined or longer period has elapsed, the printhead is moved to the outside the print medium, and the preliminary discharge is performed.

However, in a case where the preliminary discharge operation is frequently performed, the printing speed (throughput) is reduced, and the ink consumption for other operation than actual printing increases the running cost.

To overcome the drawbacks, Japanese Published Unexamined Patent Application No. Sho 63-252748, for example, proposes, on one hand, counting the number of driven times of each of plural print elements at predetermined time intervals and performing preliminary discharge if the count value is less than a predetermined value and, on the other hand, if the count value is equal to/greater than the predetermined value, not performing the preliminary discharge.

However, although the above conventional control is effective as long as a time interval to assure normal printing is longer than the period of one scanning of the printhead, if the time interval is equal or nearly equal to the scanning period, the efficiency of the control is low. In the conventional art, in a case where the time interval to assure normal printing is equal or nearly equal to the period of one scanning, it is necessary to perform the preliminary discharge upon each scanning considering that printing is concentrated immediately after the start of print scanning. In other words, it is necessary to perform the preliminary discharge upon each print scanning regardless of the count value of the number of driven times of the print elements.

In this case, the conventional control is utterly wasteful and the preliminary discharge is inefficient.

SUMMARY OF THE INVENTION

Accordingly, the present invention is conceived as a response to the above-described disadvantages of the conventional art.

For example, a printing apparatus and a preliminary discharge control method according to the present invention are capable of performing efficient preliminary discharge control even in a case where the time interval to assure normal printing is equal or nearly equal to the period of one scanning of the printhead.

According to one aspect of the present invention, preferably, a printing apparatus for printing by reciprocate-scanning an inkjet printhead discharging ink from a plurality of print elements, comprises: count means for counting a number of ink dischargings from the plurality of print elements during print scanning by reciprocate-scanning of the inkjet printhead; determination means for determining at predetermined time intervals whether or not the number of ink dischargings from each of the plurality of print elements, counted by the count means, is equal to or greater than a predetermined number; update means for updating a printable period in accordance with the result of determination by the determination means; first comparison means for comparing the printable period updated by the update means with time necessary for next print scanning, upon completion of one print scanning by the reciprocate-scanning of the inkjet printhead; and preliminary discharge control means for performing preliminary discharge from the inkjet printhead in accordance with the result of comparison by the first comparison means.

It is preferable that the apparatus further comprises scanning means for reciprocate-scanning the inkjet printhead, and the first comparison means performs a comparison when a moving direction of the inkjet printhead by the scanning means is reversed.

In this case, it is preferable that the preliminary discharge control means controls the scanning means to move the inkjet printhead to a predetermined position, e.g., a home position of the inkjet printhead so that the preliminary discharge control means can perform the preliminary discharge from the inkjet printhead.

This is because capping means for capping an ink discharge surface of the inkjet printhead, wiping means for wiping the ink discharge surface, and suction means for sucking ink from the inkjet printhead are provided in the home position of the inkjet printhead.

Further, the printable period is preferably a time period in which normal ink discharge from the inkjet printhead is expected, reset to a predetermined initial value prior to start of the print scanning, and reset to the predetermined initial value when the preliminary discharge is performed by the preliminary discharge control means.

Further, it is preferable that if it is determined that all the numbers of ink dischargings from all of the plurality of print elements, counted by the count means, are less than the predetermined number, the update means reduces the printable period by a predetermined period and resets the values counted by the count means.

Note that it is preferable that the preliminary discharge includes: first preliminary discharge to perform ink discharge a first number of times; and second preliminary discharge to perform ink discharge a second number of times more than the first number of times. In this case, it is preferable that the apparatus further manages an elapsed time from execution of the second preliminary discharge, and compares the managed elapsed time with a predetermined threshold value, and the preliminary discharge control means performs the second preliminary discharge in accordance with the result of the comparison.

Further, it is preferable that the inkjet printhead has an electrothermal transducer to generate thermal energy to be supplied to ink so as to discharge the ink utilizing the thermal energy.

According to another aspect of the present invention, preferably, a method of controlling preliminary discharge of an inkjet printhead which discharges ink from a plurality of print elements, and is mounted on a reciprocate-scanned carriage, comprises: a count step of counting a number of ink dischargings from the plurality of print elements during print scanning by reciprocate scanning of the inkjet printhead; a determination step of determining at predetermined time intervals whether or not the number of ink dischargings from each of the plurality of print elements, counted at the count step, is equal to or greater than a predetermined number; an update step of updating a printable period in accordance with the result of determination at the determination step; a first comparison step of comparing the printable period updated at the update step with time necessary for next print scanning, upon completion of one print scanning by the reciprocate-scanning of the inkjet printhead; and a preliminary discharge control step of performing preliminary discharge from the inkjet printhead in accordance with the result of comparison at the first comparison step.

According to still another aspect of the present invention, preferably, a printing apparatus for printing by using an inkjet printhead discharging ink from a plurality of print elements, comprises: preliminary discharge means for performing preliminary discharge from the plurality of print elements; timer means for measuring a first period necessary for next preliminary discharge; calculation means for calculating a second period necessary for next printing in predetermined units; and preliminary discharge control means for comparing the first period with the second period, and performing the preliminary discharge in accordance with the result of comparison.

According to still another aspect of the present invention, preferably, a preliminary discharge control method adapted to a printing apparatus for printing by using an inkjet printhead discharging ink from a plurality of print elements, comprises: a preliminary discharge step of performing preliminary discharge from the plurality of print elements; a timer step of measuring a first period necessary for next preliminary discharge; a calculation step of calculating a second period necessary for next printing in predetermined units; and a preliminary discharge control step of comparing the first period with the second period, and performing the preliminary discharge in accordance with the result of comparison.

In accordance with the present invention as described above, in the inkjet printhead, mounted on a reciprocate-scanned carriage, which performs printing by discharging ink from a plurality of print elements, the number of ink dischargings from the respective plural print elements is counted during print scanning by the reciprocate-scanning of the inkjet printhead. Then, it is determined whether or not the number of ink dischargings from the respective plural print elements has reached a predetermined number, at predetermined time intervals, and in accordance with each result of determination, a printable period is updated. The updated printable period is compared with time necessary for the next print scanning upon completion of one print scanning by the inkjet printhead, and the preliminary discharge from the inkjet printhead is performed in accordance with the result of comparison.

The invention is particularly advantageous since even in a case where the time interval to assure normal printing is equal or nearly equal to the period of one scanning of the inkjet printhead, the preliminary discharge operation can be efficiently performed.

This results in improving printing throughput and reducing an amount of ink consumption for preliminary discharge.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Note that the following embodiment exemplifies a printing apparatus which employs an inkjet printhead.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, the term "nozzle" generally means a set of a discharge orifice, a liquid channel connected to the orifice and an element to generate energy utilized for ink discharge.

<Inkjet Printing Apparatus (FIG. 1)>

Figure 1:
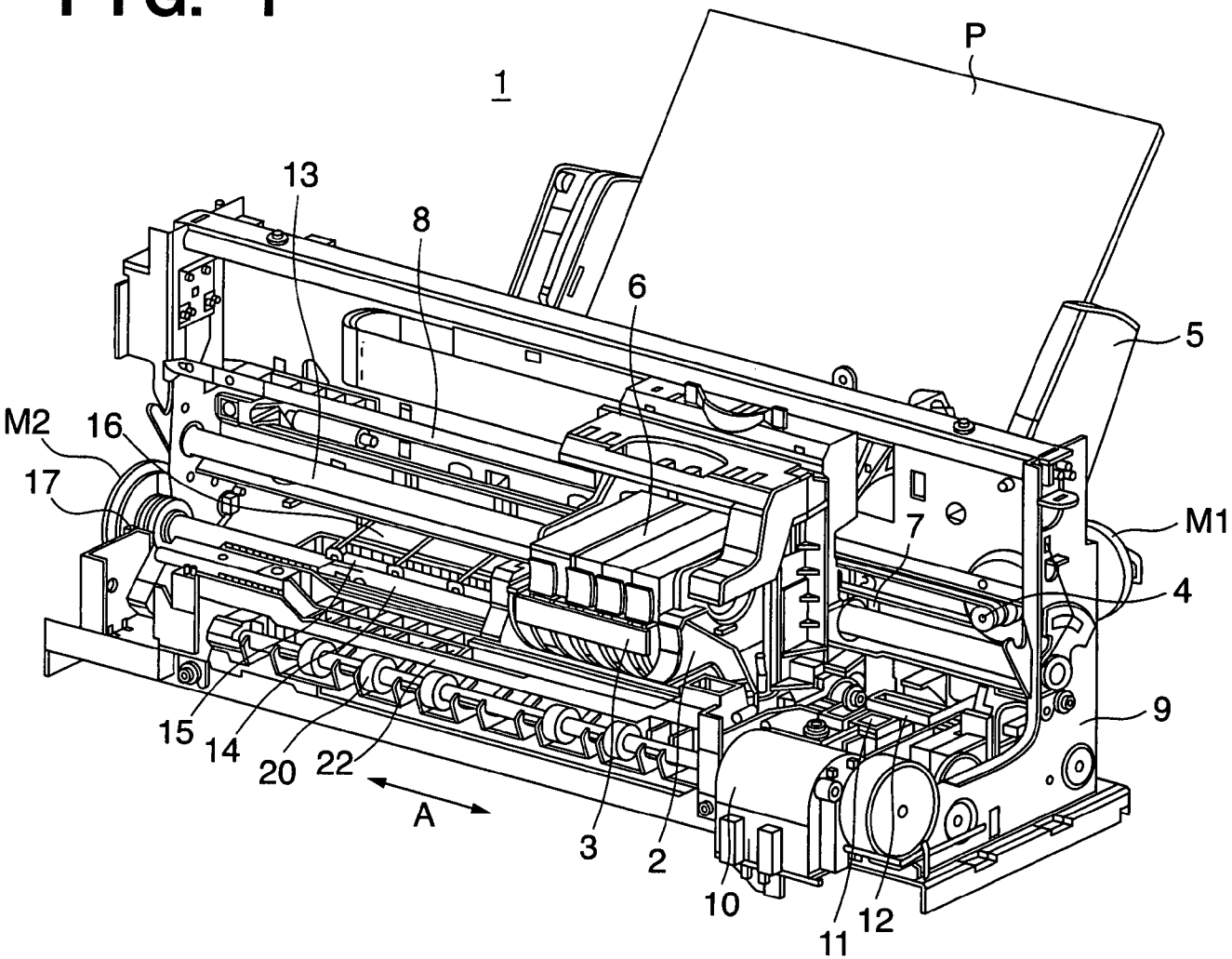
FIG. 1 is a perspective view showing the structure of an inkjet printing apparatus as a typical embodiment of the present invention.

FIG. 1 is a perspective view showing the structure of an inkjet printing apparatus as a typical embodiment of the present invention.

As shown in FIG. 1, an inkjet printing apparatus (hereinbelow, referred to as a "printing apparatus") 1 transmits a driving force generated by a carriage motor M1 to a carriage 2 holding a printhead 3, which performs printing by discharging ink in accordance with an inkjet method, by a transmission mechanism 4, and reciprocate-moves the carriage 2 in an arrow A direction, and, for example, supplies a print medium P such as a print sheet via a paper feed mechanism 5, conveys the print medium to a printing position, and performs printing by discharging ink from the printhead 3 onto the print medium P in the printing position.

Further, to maintain an excellent status of the printhead 3, the carriage 2 is moved to the position of a recovery device 10, and discharge recovery processing is intermittently performed on the printhead 3.

In addition to the printhead 3, an ink cartridge 6 containing ink to be supplied to the printhead 3 is attached to the carriage 2 of the printing apparatus 1. The ink cartridge 6 is removable from the carriage 2.

The printing apparatus 1 in FIG. 1 is capable of color printing, and for this purpose, has four ink cartridges containing magenta (M), cyan (C), yellow (Y) and black (K) inks. These four ink cartridges are respectively removable.

As junction surfaces of the carriage 2 and the printhead 3 are in appropriate contact, necessary electrical connection can be maintained between both members. The printhead 3 selectively discharges the ink from the plural discharge orifices by application of energy in correspondence with a print signal. Particularly in the present embodiment, the printhead 3 employs an ink-jet method of discharging ink utilizing thermal energy, and has electrothermal transducers to convert applied electrical energy into thermal energy. The printhead 3 discharges the ink from the discharge orifices by utilizing pressure change caused by growth and shrinkage of bubbles by film boiling in the ink by application of thermal energy. The electrothermal transducers are provided corresponding to the respective discharge orifices, and the ink is discharged from corresponding discharge orifices by application of pulse voltage to corresponding electrothermal transducers in accordance with a print signal.

As shown in FIG. 1, the carriage 2 is connected to a part of a drive belt 7 of the transmission mechanism 4 to transmit the driving force of the carriage motor M1, and is slidably guided along a guide shaft 13 in the arrow A direction. Accordingly, the carriage 2 reciprocates along the guide shaft 13 by forward and reverse rotation of the carriage motor M1. Further, a scale 8 to indicate the absolute position of the carriage 2 is provided along the moving direction (arrow A direction) of the carriage 2. In this embodiment, as the scale 8, a transparent PET film on which black bars are printed is employed, and one end of the scale 8 is fixed to a chassis 9 while the other end is supported with a plate spring (not shown).

Further, the printing apparatus 1 is provided with a platen (not shown) opposite to a discharge orifice surface of the printhead 3 where the discharge orifices (not shown) of the printhead 3 are formed. The carriage 2 holding the printhead 3 is reciprocated by the driving force of the carriage motor M1, at the same time a print signal is supplied to the printhead 3 and the ink is discharged in accordance with the print signal, thereby printing is performed over the entire width of the print medium P conveyed onto the platen.

Further, in FIG. 1, numeral 14 denotes a conveyance roller driven by a conveyance motor M2 to convey the print medium P; 15, a pinch roller to bring the print medium P into contact with the conveyance roller 14 by a spring (not shown); 16, a pinch roller holder to rotatably support the pinch roller 15; and 17, a conveyance roller gear fixed to an end of the conveyance roller 14. The conveyance roller 14 is driven by rotation of the conveyance motor M2 transmitted via an intermediate gear (not shown) to the conveyance roller gear 17.

Further, numeral 20 denotes a discharge roller to discharge the print medium P where an image has been formed by the printhead 3 to the outside of the printing apparatus. The discharge roller 20 is driven by the rotation force transmitted from the conveyance motor M2. Note that the discharge roller 20 comes into contact with the print medium P by a spur roller (not shown) in press-contact with the discharge roller with a spring (not shown). Numeral 22 denotes a spur holder to rotatably support the spur roller.

Further, as shown in FIG. 1, the printing apparatus 1 is provided with a recovery device 10 to recover discharge failure in the printhead 3 in a desired position (e.g., a position corresponding to a home position) outside an area of the reciprocating motion of the carriage 2 holding the printhead 3 for printing operation (outside the printing area).

The recovery device 10 has a capping mechanism 11 to cap the discharge orifice surface of the printhead 3, and a wiping mechanism 12 to wipe the discharge orifice surface of the printhead 3. The recovery device 10 performs discharge recovery processing of forcibly discharging the ink from the discharge orifices by suction means (suction pump or the like) in the recovery device, in cooperation with capping on the discharge orifice surface by the capping mechanism 11, thereby removing viscosity-increased ink, bubbles and the like from the ink channels of the printhead 3.

Further, in a non-printing period, the discharge orifice surface of the printhead 3 is capped by the capping mechanism 11, thereby the printhead 3 is protected and evaporation and drying of the ink can be prevented. On the other hand, the wiping mechanism 12, provided around the capping mechanism 11, wipes out ink droplets adhered to the discharge orifice surface of the printhead 3.

By the capping mechanism 11 and the wiping mechanism 12, a normal ink discharge status can be maintained in the printhead 3.

<Control Construction of Inkjet Printing Apparatus (FIG. 2)>

Figure 2:
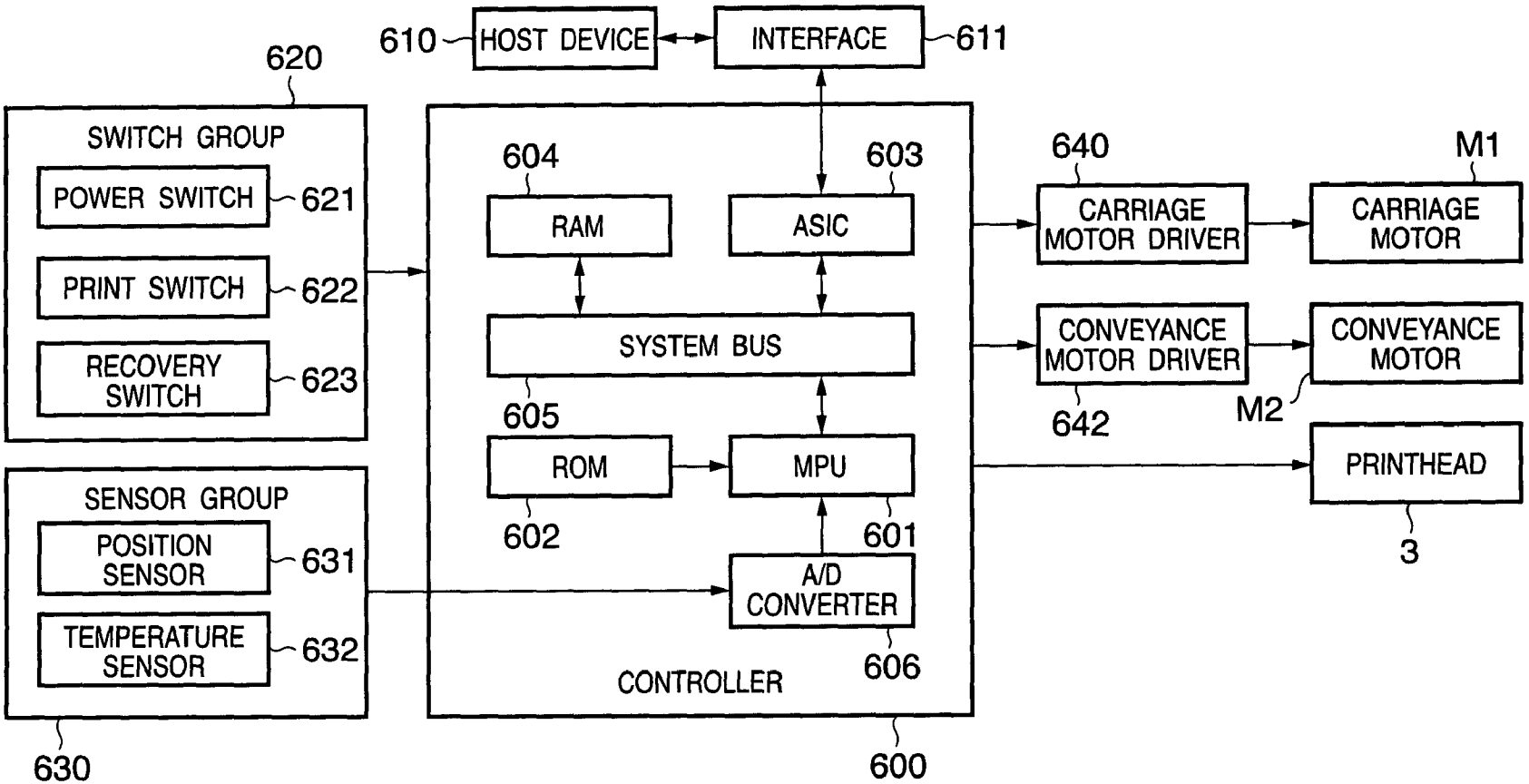
FIG. 2 is a block diagram showing the construction of a control circuit of the inkjet printing apparatus in FIG. 1.

FIG. 2 is a block diagram showing a control construction of the printing apparatus in FIG. 1.

As shown in FIG. 2, a controller 600 has an MPU 601, a ROM 602 storing a program corresponding to a control sequence to be described later, a required table and other fixed data, an Application Specific Integrated Circuit (ASIC) 603 for controlling the carriage motor M1 and the conveyance motor M2, and generating a control signal for the printhead 3, a RAM 604 including a bitmap area for mapping of image data and a work area for program execution, a system bus 605 interconnecting the MPU 601, the ASIC 603 and the RAM 604 for data transmission/reception, and an A/D converter 606 for inputting analog signals from a sensor group to be described below, then A/D-converting the signals and supplying digital signals to the MPU 601.

Further, in FIG. 2, numeral 610 denotes a computer as a image data supply source (otherwise an image reader or digital camera) referred to as a host device. Image data, command and status signals and the like are transmitted/received between the host device 610 and the printing apparatus 1 via an interface (I/F) 611.

Further, numeral 620 denotes a switch group comprised of switches to receive instruction inputs from an operator such as a power switch 621, a print switch 622 used for instructing to start printing and a recovery switch 623 used for instructing to start processing (recovery processing) to maintain an excellent ink discharge performance in the printhead 3. Numeral 630 denotes a sensor group to detect an apparatus status comprised of a position sensor 631 such as a photo coupler to detect a home position h, and a temperature sensor 632 provided in an appropriate position of the printing apparatus to detect an environmental temperature.

Further, numeral 640 denotes a carriage motor driver to drive the carriage motor M1 to reciprocate-scan the carriage 2 in the arrow A direction; and 642, a conveyance motor driver to drive the conveyance motor M2 to convey the print medium P.

The printing apparatus main body having the above construction interprets a command of print data transferred via the interface 611 and bitmaps the image data used for printing on the RAM 602. The bitmap area (bitmap buffer) for the image data is a two-dimensional rectangular area, with its lateral size corresponding to the number of pixels Hp for a printable area in the carriage moving direction (main-scanning direction) and its vertical size corresponding to ¼ of the number of pixels in the print medium conveyance direction (subscanning direction) for 1 print scanning of the printhead, 16×16c (i.e., 64c pixels). The bitmap area is ensured on the RAM 602.

Further, a storage area (print buffer) on the RAM 602 referred to for transfer of print data to the printhead 3 upon print scanning is also a two-dimensional rectangular area, with its lateral size corresponding to the number of pixels Hp for the printable area in the main-scanning direction and its vertical size corresponding to the number of pixels 16×16c in the subscanning direction for 1 print scanning of the printhead. The storage area is also ensured on the RAM 602.

Upon print scanning of the printhead 3, the ASIC 603 directly accesses the storage area on the RAM 602 while transferring driving data (DATA) to drive print elements (discharge heaters) to the printhead.

Next, preliminary discharge control processing in the printing apparatus having the above construction will be described.

Figure 3:
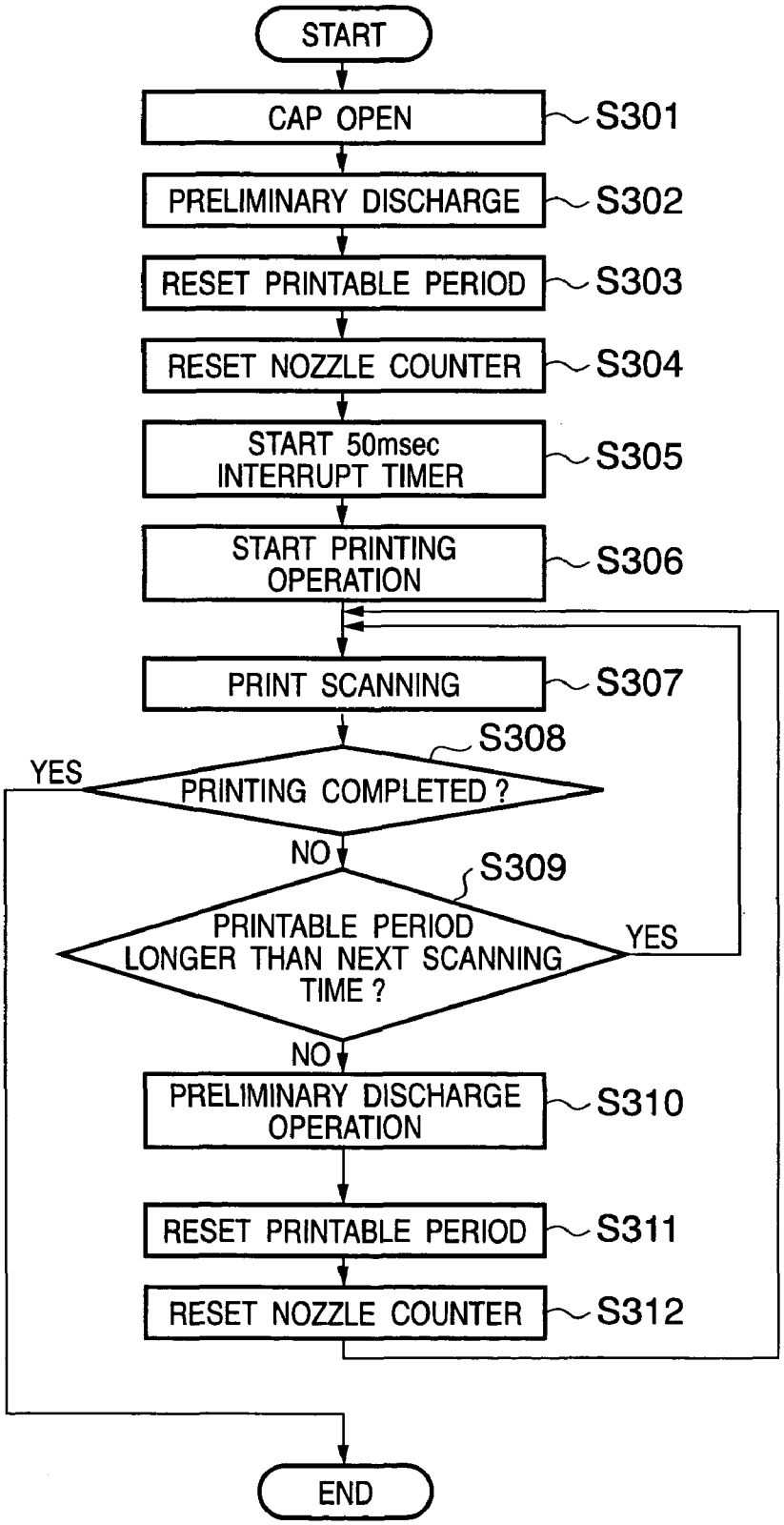
FIG. 3 is a flowchart showing preliminary discharge control processing.

FIG. 3 is a flowchart showing preliminary discharge control processing. The processing is performed by reading the control program stored in the ROM 602 and executing the program by the MPU 601.

First, in a status where the printing apparatus 1 waits for print data from the host device (hereinbelow, "host") 610, the discharge orifices of the nozzles of the printhead 3 are capped by the capping mechanism 11 for preventing evaporation of water and solvent from the discharge orifices.

In this status, when print data is received from the host 610, the capping mechanism 11 is operated to release the capped status of the discharge orifice surface of the printhead 3 at step S301, then at step S302, preliminary discharge is performed.

After the preliminary discharge operation, the process proceeds to step S303, at which a printable period ($P_{ENBL}$) is initialized to a predetermined value, then at step S304, a count value ($D_{count}$(i)i=1,N) of a nozzle counter to count the number of discharge drivings per each print element of the printhead 3 is initialized to "0". Further, at step S305, an interrupt timer is started to generate timing to update the printable period ($P_{ENBL}$) at predetermined time intervals.

In this embodiment, the interrupt time interval ($T_{INRT}$) is 50 msec. Further, "N" means the number of print elements. The printable period ($P_{ENBL}$) is defined as a period where normal ink discharge from the printhead is expected, and is determined in accordance with the performance of the printhead and/or the printing apparatus.

Next, the interrupt processing at 50 msec intervals will be described. The interrupt processing is executed regardless of whether or not print scanning is performed, as long as the printhead 3 is not capped (cap open status).

Figure 4:
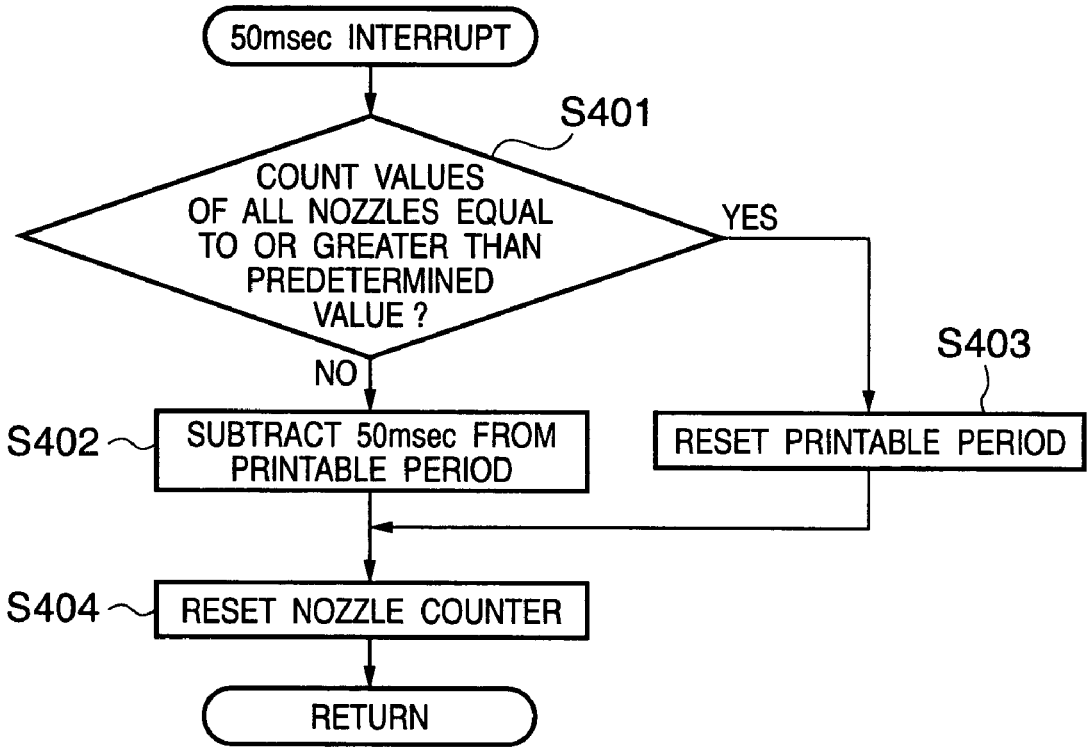
FIG. 4 is a flowchart showing interrupt processing by an interrupt timer.

FIG. 4 is a flowchart showing the interrupt processing by the interrupt timer.

First, at step S401, it is determined whether or not all the nozzle counter values ($D_{count}$(i)i=1,N) are equal to or greater than a predetermined value (TH). In this embodiment, TH=3 holds as the predetermined value. If $D_{count} \geqq 3$ holds regarding all the count values, the process proceeds to step S403, at which the printable period ($P_{ENBL}$) is reset and initialized. In this embodiment, the initial value for the printable period ($P_{ENBL}$) is 1 second. On the other hand, if $D_{count} < 3$ holds in any of the count values, the process proceeds to step S402, at which 50 msec is subtracted from the printable period ($P_{ENBL}$), as a new printable period ($P_{ENBL}$).

After the processing at step S402 or S403, all the nozzle counter values ($D_{count}$(i)i=1,N) are initialized to "0" at step S404.

Next, at step S307, the printhead 3 is moved and print scanning is performed.

During the print scanning, the moving speed of the printhead 3 slows down, and thereafter, the moving direction is reversed, and the speed is increased for the next print scanning. In this embodiment, after the completion of 1 print scanning, before the moving speed of the printhead 3 slows down, it is determined at step S308 whether or not the printing has been completed. If it is determined that the printing has been completed, the process ends, while if it is determined that the printing is continued, the process proceeds to step S309, at which the printable period ($P_{ENBL}$) at that time is compared with time necessary for the next print scanning ($T_{scan}$).

If $P_{ENBL} \geqq T_{scan}$ holds, the process returns to step S307, while if $P_{ENBL} < T_{scan}$ holds, it is determined that preliminary discharge is necessary, and the process proceeds to step S310.

At step S310, the printhead 3 is moved to a preliminary discharge position and the preliminary discharge is performed there. In this embodiment, the preliminary discharge position is a cap position as the home position of the printhead 3. Next, at step S311, the printable period ($P_{ENBL}$) is initialized, and further at step S312, all the nozzle counter values ($D_{count}$(i)i=1, N) are initialized to "0". Thereafter, the processing returns to step S307.

In a case where the process ends in accordance with the determination at step S308, the next print command is waited for a predetermined period. If the print command is not received in the standby status, the capping mechanism 11 is operated to cap the printhead 3. On the other hand, if the print command is received in the standby status, the process proceeds to step S307, at which the print scanning is started again.

In accordance with the above-described embodiment, upon completion of each print scanning, the printable period for printing without preliminary discharge is compared with time necessary for the next print scanning, and the preliminary discharge operation is performed in accordance with the result of comparison. The reduction of throughput due to execution of preliminary discharge can be suppressed to a minimum and efficient preliminary discharge can be realized with a minimum number of preliminary discharge operations.

Note that it may be arranged such that in a printhead where the interval of preliminary discharge is long, the comparison is made with a predetermined threshold value by plural scannings.

[Other Embodiment]

In the above-described embodiment, the minimum number of discharges per 1 nozzle within the printable period is determined with a predetermined threshold value (TH). Accordingly, if the threshold value is set to a large value and the number of dischargings upon preliminary discharge in a case where the count value is equal to or less than the threshold value is set to a large value, the reliability of discharge upon printing is increased. However, in the case where the predetermined value is set to a large value, there is a high probability of preliminary discharge at each interval between printing scannings. To effectively utilize the advantage of this function, it is preferable that the predetermined value (TH) is as small as possible and the number of dischargings upon preliminary discharge in a case where the count value is equal to or less than the threshold value is set to the same as the predetermined value.

However, in a case where the minimum number of dischargings per 1 nozzle within the printable period is reduced, there is no problem even if the minimum number of dischargings within the printable period is repeated several times, however, as the number of repetition increases, the discharge status gradually becomes poor. It is considered that ink within the nozzles is replaced with new ink to some degree but is not fully replaced, and this may cause the poor discharge status. To fully replace the ink within the nozzle with new ink, a large amount of discharging is required.

In this embodiment, to solve the above-described problem, the following control is performed.

That is, in this embodiment, provided is a preliminary discharge type B, in which the number of ink dischargings is equal to the predetermined value (TH) in the above-described embodiment, and a preliminary discharge type A, in which the number of ink dischargings is larger than that of the preliminary discharge type B. In addition to the preliminary discharge control performed in the above-described embodiment, the preliminary discharge type A is performed at predetermined intervals, thereby the above-described problem can be solved.

Figure 5:
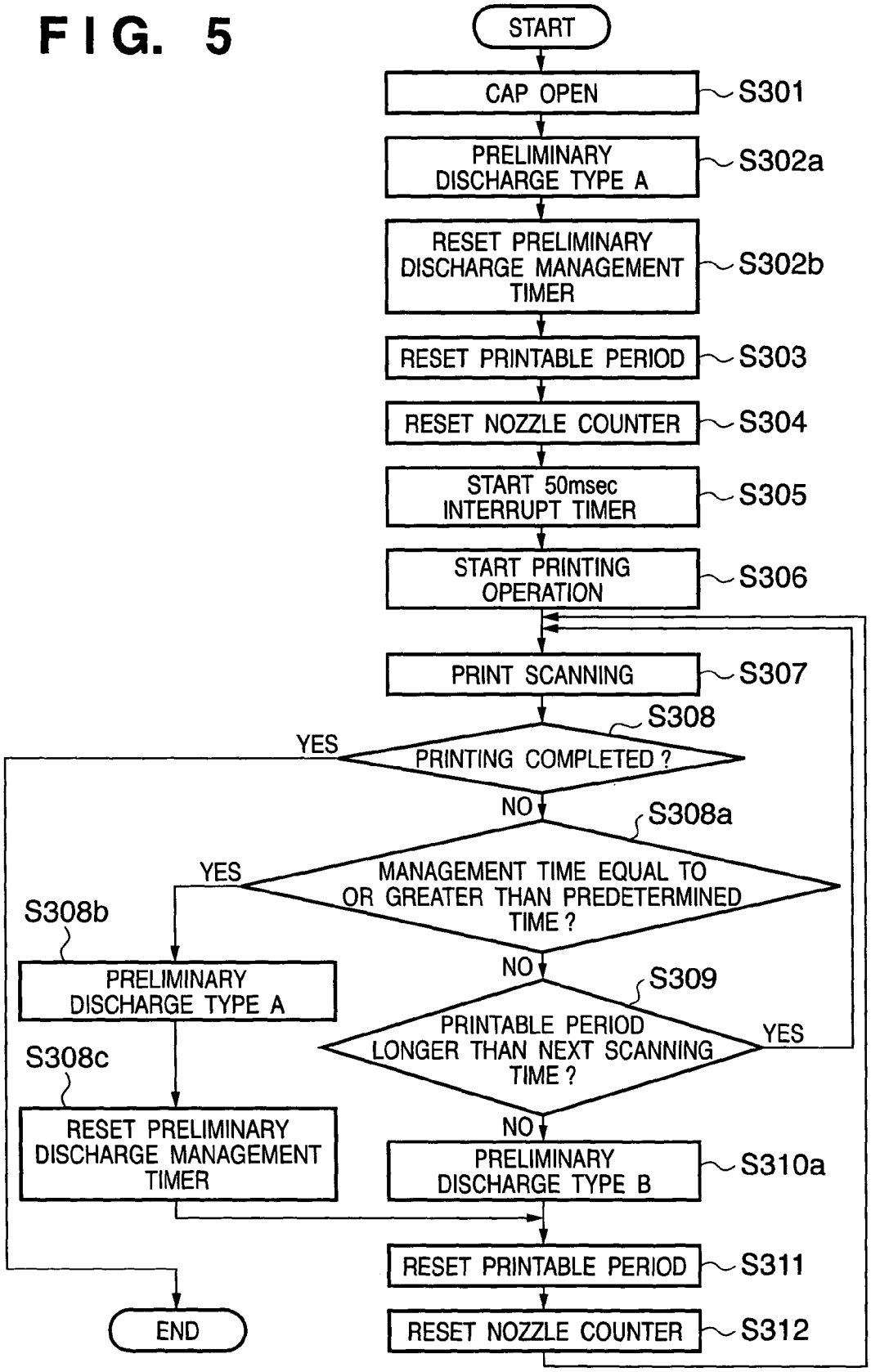
FIG. 5 is a flowchart showing preliminary discharge control processing according to another embodiment.

FIG. 5 is a flowchart showing the preliminary discharge control processing according to this embodiment.

Note that in FIG. 5, the same processing steps as those already described in the above-described embodiment have the same step reference numerals, and explanations thereof will be omitted. Further, also in this embodiment, the interrupt processing is performed at 50 msec intervals. Accordingly, only processing characteristic of the present embodiment will be described below.

First, after step S301, the preliminary discharge type A is performed at step S302*a*, and at step S302*b*, a preliminary discharge management timer ($T_{PD}$), for the preliminary discharge type A at predetermined intervals, is reset. The timer is automatically updated in time. Thereafter, the processings at steps S303 to S308 are performed.

Then at step S308, if it is determined that the printing has not been completed, the process proceeds to step S308*a*, at which it is determined whether or not the time value indicated by the preliminary discharge management timer ($T_{PD}$) is equal to or greater than predetermined time ($T_0$).

If $T_{PD} \geqq T_0$ holds, it is determined that the preliminary discharge type A must be performed, and the process proceeds to step S308*b*, at which the printhead 3 is moved to the preliminary discharge position, and the preliminary discharge type A is performed. Next, at step S308*c*, the value of the preliminary discharge management timer ($T_{PD}$) is initialized to "0". Thereafter, the process proceeds to step S311.

On the other hand, if $T_{PD} < T_0$ holds, it is determined that the preliminary discharge type A is not necessary and the process proceeds to step S309. At step S309, if $P_{ENBL} \geqq T_{scan}$ holds, it is determined that the preliminary discharge is not necessary and the process returns to step S307. However, if $P_{ENBL} < T_{scan}$ holds, it is determined that the preliminary discharge must be performed, and the process proceeds to step S310*a*. At step S310*a*, the printhead 3 is moved to the preliminary discharge position, and the preliminary discharge type B is performed. Next, the process proceeds to step S311, to perform the same processing as that described in the previous embodiment.

Note that in this embodiment, the predetermined time ($T_0$) as time interval for execution of the preliminary discharge type A is 5 sec.

According to the present embodiment, as the preliminary discharge type A, in which the number of ink dischargings is larger than that of the preliminary discharge type B, in which the number of ink dischargings is equal to the predetermined value (TH) described in the previous embodiment, is performed at predetermined intervals, the ink within the nozzle can be fully replaced with new ink, and as a result, an excellent discharge status can be maintained.

Note that it is assumed in the above-described embodiments that the interval of preliminary discharge is short, however, as the time ($T_{scan}$) necessary for the next print scanning used as the threshold value for determination is determined in accordance with the performance of the printing apparatus and the printhead, even if the interval of preliminary discharge is long, an efficient preliminary discharge operation can be performed.

For example, in a case where the printhead has plural types of nozzles, the intervals of preliminary discharge for the different types of nozzles are different from each other. In this case, a small interval value among the different interval values may be used as a threshold value for the preliminary discharge control. Further, the printable period ($P_{ENBL}$) may be managed by nozzle type, a threshold value for comparison of nozzle counter values may be changed by nozzle type, or counting by the nozzle counter may be performed or not performed in accordance with nozzle type.

Further, in the above-described embodiments, the printhead uses a so-called thermal method to discharge ink by foaming force caused by application of thermal energy generated by an electrothermal transducer to the ink, however, the present invention is not limited to this method. It may be arranged such that, as long as the printing apparatus is an inkjet printing apparatus in which the inconvenience of poor ink discharge occurs due to evaporation of water or solvent in ink, a printhead using a piezoelectric actuator such as a piezo device to discharge ink may be employed.

Note that in the above embodiments, the liquid discharged from the printhead has been described as ink, and the liquid contained in the ink tank has been described as ink. However, the liquid is not limited to ink. For example, the ink tank may contain processing liquid or the like discharged to a print medium to improve fixability or water repellency of a printed image or to increase the image quality.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main body and can receive ink from the apparatus main body upon being mounted on the apparatus main body can be employed as well as a cartridge type printhead in which an ink tank is integrally arranged on the printhead itself as described in the above embodiment.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, the ink-jet printer of the present invention may be used in the form of a copying machine combined with a reader and the like, or a facsimile apparatus having a transmission/reception function in addition to an image output terminal of an information processing apparatus such as a computer.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for printing by reciprocate-scanning an inkjet printhead discharging ink from a plurality of print elements, comprising:

count means for counting a number of ink dischargings from the plurality of print elements during print scanning by reciprocate-scanning of the inkjet printhead;

determination means for determining at predetermined time intervals whether or not the number of ink dischargings from each of the plurality of print elements, counted by said count means, is equal to or greater than a predetermined number;

update means for updating a printable period in accordance with the result of determination by said determination means;

comparison means for comparing the printable period updated by said update means with time necessary for a next print scanning, upon completion of one print scanning by the reciprocate-scanning of the inkjet printhead; and preliminary discharge control means for performing preliminary discharge from said the inkjet printhead in accordance with the result of comparison by said comparison means.

2. The apparatus according to claim 1, further comprising scanning means for reciprocate-scanning the inkjet printhead, wherein said comparison means performs the comparison when a moving direction of the inkjet print head by said scanning means is reversed.

3. The apparatus according to claim 2, wherein if said preliminary discharge control means performs the preliminary discharge from the inkjet printhead, said preliminary discharge control means controls said scanning means to move the inkjet printhead to a predetermined position.

4. The apparatus according to claim 3, wherein the predetermined position is a home position of the inkjet printhead.

5. The apparatus according to claim 4, further comprising, at the home position of the inkjet printhead:

capping means for capping an ink discharge surface of the inkjet printhead;

wiping means for wiping the ink discharge surface; and suction means for sucking ink from the jet printhead.

6. The apparatus according to claim 1, wherein the printable period is a time period in which normal ink discharge from the inkjet print head is expected, reset to a predetermined initial value prior to start of the print scanning, and reset to the predetermined initial value when the preliminary discharge is performed by said preliminary discharge control means.

7. The apparatus according to claim 6, wherein if determined that a cumulative number of ink dischargings from all of the plurality of print elements, counted by said count means, is less than the predetermined number, said update means reduces the printable period by a predetermined period and resets the values counted by said count means.

8. The apparatus according to claim 1, wherein the preliminary discharge includes a first preliminary discharge to perform ink discharge a first number of times, and a second preliminary discharge to perform ink discharge a second number of times greater than the first number of times.

9. The apparatus according to claim 8, further comprising:

management means for managing an elapsed time from execution of the second preliminary discharge; and second comparison means for comparing the elapsed time managed by said management means with a predetermined threshold value, wherein said preliminary discharge control means performs the second preliminary discharge in accordance with the result of comparison by said second comparison means.

10. The apparatus according to claim 1, wherein the inkjet printhead has an electrothermal transducer to generate thermal energy to be applied to ink so as to discharge the ink.

11. A method of controlling preliminary discharge of an inkjet printhead which discharges ink from a plurality of print elements, and is mounted on a reciprocate-scanned carriage, comprising:

a count step of counting a number of ink dischargings from the plurality of print elements during print scanning by reciprocate-scanning of the inkjet printhead;

a determination step of determining at predetermined time intervals whether or not the number of ink dischargings from each of the plurality of print elements, counted at said count step, is equal to or greater than a predetermined number;

an update step of updating a printable period in accordance with the result of determination at said determination step;

a comparison step of comparing the printable period updated at said update step with time necessary for a next print scanning, upon completion of one print scanning by the reciprocate-scanning of the inkjet printhead; and a preliminary discharge control step of performing preliminary discharge from the inkjet printhead in accordance with the result of comparison at said comparison step.

12. The method according to claim 11, wherein the preliminary discharge comprises a first preliminary discharge to perform ink discharge a first number of times, and a second preliminary discharge to perform ink discharge a second number of times greater than the first number of times.

13. The method according to claim 12, further comprising:

a management step of managing an elapsed time from execution of the second preliminary discharge; and a second comparison step of comparing the elapsed time managed at said management step with a predetermined threshold value, wherein at said preliminary discharge control step, the second preliminary discharge is performed in accordance with the result of comparison at said second comparison step.

* * * * *

UNITED STATES PATENT AND TRADEMARK OFFICE

CERTIFICATE OF CORRECTION

PATENT NO. : 7,011,386 B2
APPLICATION NO. : 10/636687
DATED : March 14, 2006
INVENTOR(S) : Osamu Iwasaki et al.

It is certified that error appears in the above-identified patent and that said Letters Patent is hereby corrected as shown below:

COLUMN 1
Line 21, “the with” should read --with the--.

COLUMN 13
Line 13, “said the” should read --the--.
Line 20, “print head” should read --printhead--.
Line 36, “jet” should read --inkjet--.
Line 39, “print head” should read --printhead--.

Signed and Sealed this

Twenty-fourth Day of July, 2007

JON W. DUDAS
*Director of the United States Patent and Trademark Office*